US011781388B2

(12) United States Patent
Hasler et al.

(10) Patent No.: US 11,781,388 B2
(45) Date of Patent: Oct. 10, 2023

(54) AUTO-FILLING TUBULARS

(71) Applicant: Nabors Drilling Technologies USA, Inc., Houston, TX (US)

(72) Inventors: David Hasler, Houston, TX (US); Pradeep Annaiyappa, Houston, TX (US); David G. Shackelford, Magnolia, TX (US)

(73) Assignee: Nabors Drilling Technologies USA, Inc., Houston, TX (US)

( * ) Notice: Subject to any disclaimer, the term of this patent is extended or adjusted under 35 U.S.C. 154(b) by 0 days.

(21) Appl. No.: 17/652,641

(22) Filed: Feb. 25, 2022

(65) Prior Publication Data

US 2022/0290515 A1 Sep. 15, 2022

Related U.S. Application Data

(60) Provisional application No. 63/160,635, filed on Mar. 12, 2021.

(51) Int. Cl.
*E21B 21/08* (2006.01)
*E21B 21/01* (2006.01)
*E21B 47/003* (2012.01)

(52) U.S. Cl.
CPC ..... *E21B 21/08* (2013.01); *E21B 21/019* (2020.05); *E21B 47/003* (2020.05)

(58) Field of Classification Search
CPC ..... E21B 21/019; E21B 21/00; E21B 21/01; E21B 21/015; E21B 21/08
See application file for complete search history.

(56) References Cited

U.S. PATENT DOCUMENTS

| | | | | |
|---|---|---|---|---|
| 4,110,688 | A | 8/1978 | Bailey | |
| 4,290,305 | A * | 9/1981 | Gibson | G01F 1/007 73/152.49 |
| 7,966,569 | B2 * | 6/2011 | Pandey | E21B 41/00 702/9 |
| 10,435,984 | B2 | 10/2019 | Mericas et al. | |
| 2008/0173480 | A1 * | 7/2008 | Annaiyappa | E21B 15/00 175/24 |
| 2009/0266532 | A1 | 10/2009 | Revheim et al. | |
| 2010/0012324 | A1 * | 1/2010 | Churchill | E21B 17/006 166/306 |
| 2018/0266233 | A1 * | 9/2018 | Ahmed | E21B 47/047 |
| 2020/0190967 | A1 * | 6/2020 | Gooneratne | H04N 23/00 |
| 2020/0256141 | A1 * | 8/2020 | Hawkins, III | E21B 33/134 |
| 2021/0002995 | A1 * | 1/2021 | Botnan | E21B 19/155 |
| 2021/0277732 | A1 | 9/2021 | Parmeshwar et al. | |
| 2021/0317711 | A1 * | 10/2021 | Jordan | E21B 21/103 |
| 2023/0116558 | A1 * | 4/2023 | AlSultan | E21B 47/07 166/250.01 |

* cited by examiner

*Primary Examiner* — Shane Bomar
(74) *Attorney, Agent, or Firm* — Abel Schillinger, LLP

(57) ABSTRACT

A method for performing a subterranean operation that can include operations of engaging a tubular with a pipe handler, calculating, via a processor, an internal volume of the tubular, determining, via the processor, a number of pump strokes required to fill at least a percentage of the internal volume with fluid, pumping the fluid to the tubular by running a pump the number of pump strokes, and filling the internal volume of the tubular to at least the percentage of the internal volume with the fluid.

20 Claims, 9 Drawing Sheets

AUTO-FILLING TUBULARS

CROSS-REFERENCE TO RELATED APPLICATION(S)

This application claims priority under 35 U.S.C. § 119(e) to U.S. Patent Application No. 63/160,635, entitled "AUTO-FILLING TUBULARS," by David HASLER et al., filed Mar. 12, 2021, which application is assigned to the current assignee hereof and incorporated herein by reference in its entirety.

TECHNICAL FIELD

The present invention relates, in general, to the field of drilling and processing of wells. More particularly, present embodiments relate to a system and method for filling tubulars with working fluid during subterranean operations.

BACKGROUND

When running segmented tubular strings into a wellbore, it is generally beneficial to fill the tubular string with fluid as new segments are added to prevent damaging pressure differentials between an annulus and an internal volume in the tubular string. There are well known systems for allowing well fluid in the wellbore to enter the bottom end of the tubular string through a float shoe which can selectively enable/disable inflow of fluid from the wellbore annulus into the tubular string. However, there are other instances when it is not desirable to fill the tubular string with the wellbore fluids in the annulus. In these instances, the tubular string can be filled from the top through a fluid connection to the top drive which can supply the fluid to the newly added tubular segment. However, common flat time associated with some tubular strings (e.g., casing strings) "tripping in" the wellbore is when you need to stop and fill pipe with a fluid. This can take anywhere from 1.5 hours to 4 hours for tripping in a tubular string regardless of the running method. Therefore, improvements in tubular string running systems are continually needed.

SUMMARY

A system of one or more computers can be configured to perform particular operations or actions by virtue of having software, firmware, hardware, or a combination of them installed on the system that in operation causes or cause the system to perform the actions. One or more computer programs can be configured to perform particular operations or actions by virtue of including instructions that, when executed by data processing apparatus, cause the apparatus to perform the actions. One general aspect includes a method for performing a subterranean operation. The method can include engaging a tubular with a pipe handler; calculating, via a processor, an internal volume of the tubular; based on the internal volume, determining, via the processor, a number of pump strokes required to fill at least a percentage of the internal volume with fluid; pumping the fluid to the tubular by running a pump the number of pump strokes; and filling the internal volume of the tubular to at least the percentage of the internal volume with the fluid. Other embodiments of this aspect include corresponding computer systems, apparatus, and computer programs recorded on one or more computer storage devices, each configured to perform the actions of the methods.

Another general aspect includes a method for performing a subterranean operation. The method also includes engaging a tubular with a pipe handler; initiating, via a processor, an automated connection process which automatically connects the tubular to a tubular string at a well center; and initiating, via the processor, an automated fluid fill process which automatically fills the tubular with a fluid to a predetermined percentage of an internal volume of the tubular, while automatically connecting the tubular to the tubular string, where the automated fluid fill process may include running one or more pumps a predetermined number of pump strokes. Other embodiments of this aspect include corresponding computer systems, apparatus, and computer programs recorded on one or more computer storage devices, each configured to perform the actions of the methods.

BRIEF DESCRIPTION OF THE DRAWINGS

These and other features, aspects, and advantages of present embodiments will become better understood when the following detailed description is read with reference to the accompanying drawings in which like characters represent like parts throughout the drawings, wherein.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present), and B is false (or not present), A is false (or not present), and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

The use of the word "about", "approximately", or "substantially" is intended to mean that a value of a parameter is close to a stated value or position. However, minor differences may prevent the values or positions from being exactly as stated. Thus, differences of up to ten percent (10%) for the value are reasonable differences from the ideal goal of exactly as described. A significant difference can be when the difference is greater than ten percent (10%).

As used herein, "tubular" refers to an elongated cylindrical tube and can include any of the tubulars manipulated around a rig, such as tubular segments, tubular stands, tubulars, and tubular string, but not limited to the tubulars shown in FIG. 1. Therefore, in this disclosure, "tubular" can be synonymous with "tubular segment," "tubular stand," and "tubular string," as well as "pipe," "pipe segment," "pipe stand," "pipe string," "casing," "casing segment," or "casing string."

Figure 1A:
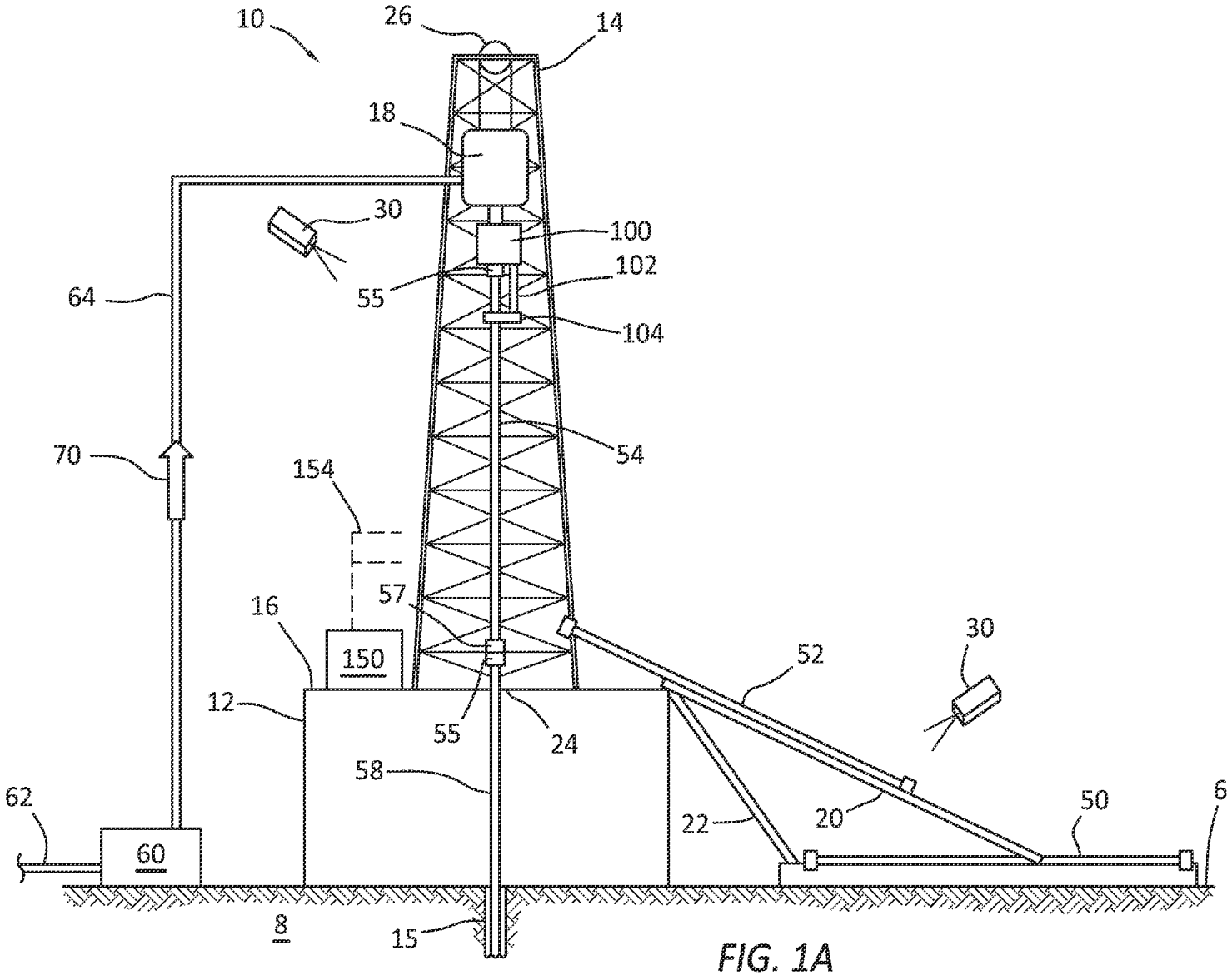
FIG. 1A is a representative functional block diagram of a system for running a tubular string into a wellbore, in accordance with certain embodiments.

FIG. 1A is a representative functional block diagram of a system 10 for running a tubular string 58 into a wellbore 15 formed through the surface 6 and into the subterranean formation 8. The system 10 can include a platform 12 with a derrick 14 extending from a rig floor 16. The derrick 14 can provide structural support for the top drive 18 and a crown block 26. The crown block 26 can be used to raise and lower the top drive 18. A tubular running tool 100 can be coupled to the top drive 18 to facilitate moving tubular segments from a catwalk 20 (or other pipe handler) to well center 24 for connection to a stump (i.e., portion of tubular string 58 protruding above the rig floor 16) at the well center 24. As the tubular string 58 is being run into (i.e., tripping in) the wellbore 15, tubular segments 54 are repeatedly added to the top end of the tubular string 58 to further extend the tubular string 58 into the wellbore 15. Therefore, tubulars 50 positioned in a horizontal (or vertical, not shown) storage area can be presented to the rig floor 16 via a catwalk 20 as it moves along a V-door ramp 22 (e.g., tubular 52). It should be understood that any other tubular manipulation systems can be used to deliver tubulars from a tubular storage area to the rig floor 16 so the top drive 18 and tubular running tool 100 can engage the tubular 52 and move it to well center 24. Therefore, this disclosure is not limited to the catwalk type pipe handler.

FIG. 1A shows a tubular 54 that has been moved from the tubular position 50, up the catwalk 20 at tubular position 52, and to a vertically oriented position at well center 24. The tubular 54 has been coupled to the tubular running tool 100 at its box end 55 and the pin end 57 of the tubular 54 has been connected to the box end 55 of the tubular string 58. The top drive 18 can receive fluid from a pump 60 via a conduit 64 and inject the fluid through the tubular running tool 100 into the top of the tubular 54 as the top drive 18 rotates and lowers the tubular 54 into the wellbore 15. The pump 60 can receive input fluid from a fluid source (not shown) via the conduit 62. Filling the tubular 54 with fluid while running the tubular 54 into the wellbore 15 can shorten the time required for tripping in the tubular string 58.

Figure 5A:
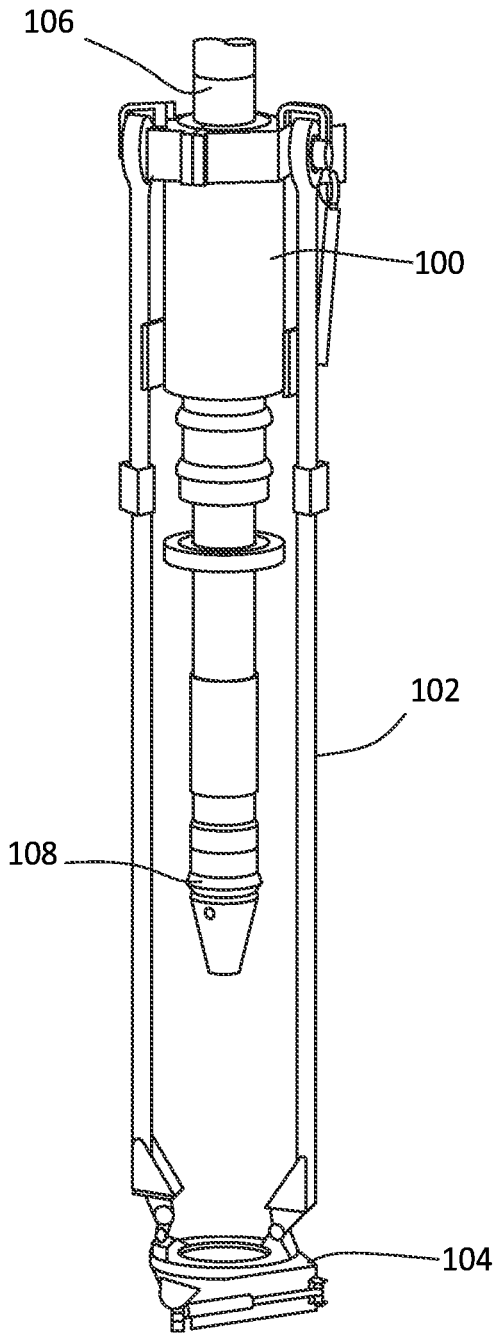
FIGS. 5A, 5B are representative side views of a tubular running tool, in accordance with certain embodiments.
Figure 5B:
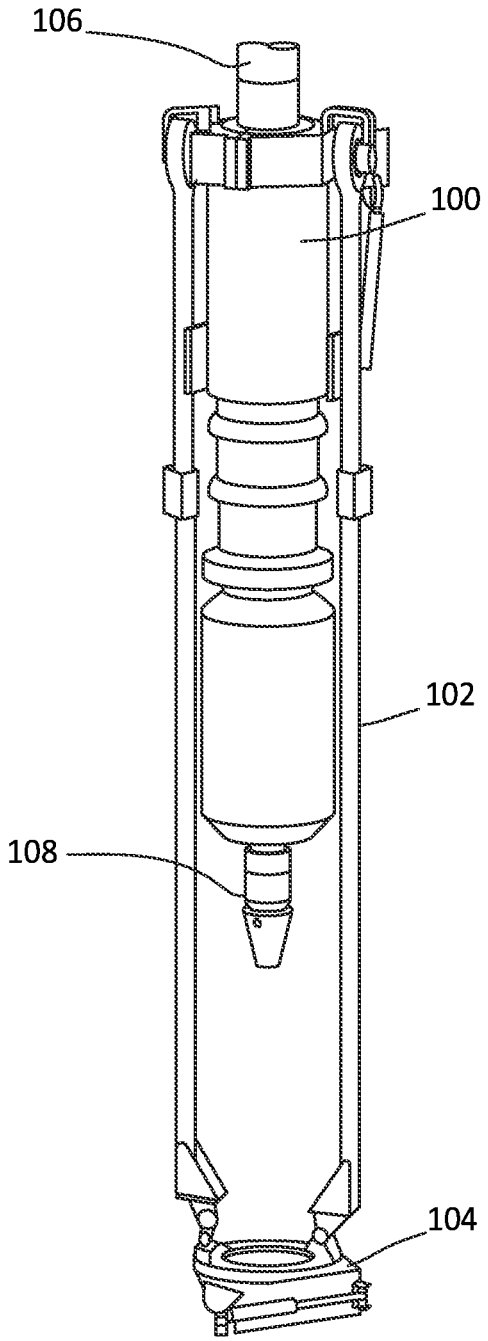

The tubular running tool 100 can include a link pair 102 rotationally coupled to the tubular running tool 100 at one end and coupled to an elevator clamp 104 at an opposite end. Example tubular running tools 100 are shown in FIGS. 5A, 5B. The elevator clamp 104 can be used to clamp around a tubular 52 and lift the tubular 52 to a vertical orientation (such as tubular 54) as the top drive 18 is raised by the crown block 26.

A rig controller 150 can include one or more processing units communicatively coupled, via a network 154 to the top drive 18 and tubular running tool 100. One or more of the processing units can be local to or remotely located from either or both of the top drive 18 and tubular running tool 100. The rig controller 150 can be configured to perform the tubular auto-fill function as the tubular 54 is being run into the wellbore 15. The rig controller 150 can be communicatively coupled to the imaging sensors 30 for collecting images of tubulars 50, 52, 54, 58 supporting the subterranean operations of the rig.

Figure 1B:
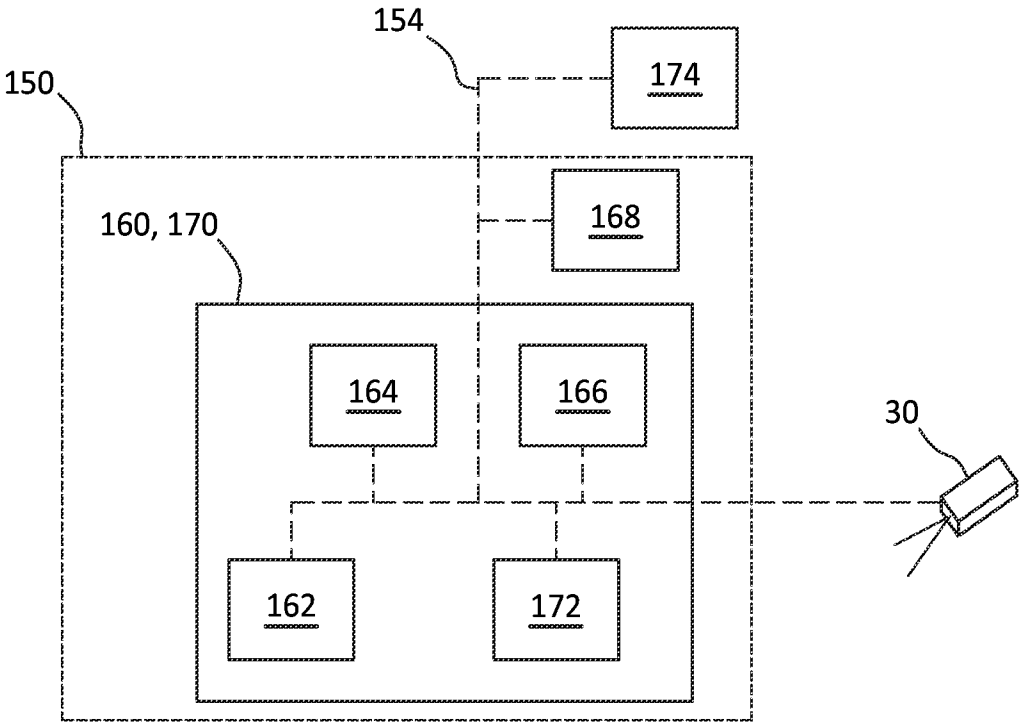
FIG. 1B is a representative functional block diagram of a rig controller from controlling the system in FIG. 1A, in accordance with certain embodiments.

Referring to FIG. 1B, the rig controller 150 can include one or more local processing units 160 that can be locally positioned with either or both the top drive 18 and tubular running tool 100 or one or more remote processing units 170 that can be remotely positioned from either or both the top drive 18 and tubular running tool 100. Each processing unit 160, 170 can include one or more processors 162, 172 (e.g., microprocessors, programmable logic arrays, programmable logic devices, etc.), non-transitory memory storage 164, peripheral interface 166, human machine interface (HMI) device(s) 168, and possibly a remote telemetry interface 174 for internet communication or satellite network communication. The HMI devices can include a touchscreen, a laptop, a desktop computer, a workstation, or wearables (e.g., smart phone, tablet, etc.). These components of the rig controller 150 can be communicatively coupled together via one or more networks 154, which be either or both wired or wireless networks.

The processors 162, 172 can be configured to read instructions from one or more non-transitory memory storage devices 164 and execute those instructions to perform any of the operations described in this disclosure. A peripheral interface 166 can be used by the rig controller 150 to receive sensor data from around the rig such as from the pump 60, the catwalk 20, the top drive 18, tubular running tool 100, etc. The peripheral interface 166 can also be used by the rig controller 150 to send commands to the pump 60, the catwalk 20, the top drive 18, tubular running tool 100, etc., to perform subterranean operations such as tripping in the tubular string 58 into the wellbore 15. The peripheral interface 166 can also be configured to communicate with one or more imaging sensors 30, which can be used to capture images of a tubular(s) and transfer the images to the processing units for determining (or verifying) characteristic(s) of the tubular(s), such as length, diameters, etc.

Figure 2:
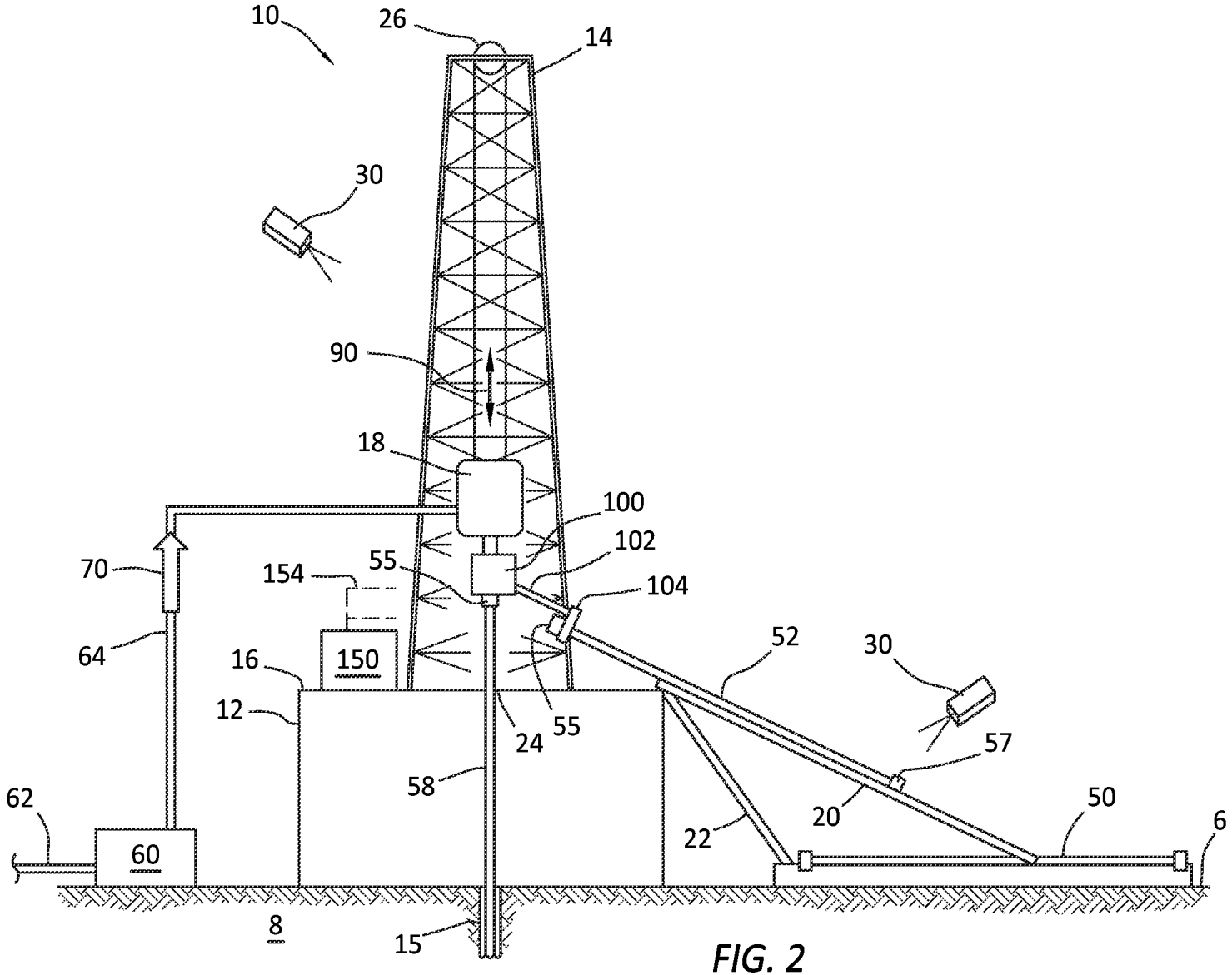
FIGS. 2-4 are representative functional block diagrams of a system in various stages of running a tubular string into a wellbore, in accordance with certain embodiments.

FIG. 2 shows the top drive 18 lowered (arrows 90) to extend the tubular string 58 further into the wellbore 15. As the top drive 18 is being lowered, the link pair 102 of the tubular running tool 100 can be rotated to a position where the elevator clamp 104 can be secured to the top (e.g., box end 55) of the next tubular 52 when the top drive 18 is at the lowermost position. Once the current tubular 54 is lowered to the desired position and it is filled with fluid up to possibly 90% of its volume via the top drive 18 and tubular running tool 100 combination, the tubular running tool 100 can disengage from the tubular 54 and allow the crown block 26 to raise the next tubular 52 (via the top drive 18 and tubular running tool 100 combination) to a height that allows the next tubular 52, 54 to be vertically positioned above the tubular string 58, which now includes the previous tubular 54.

Figure 3:
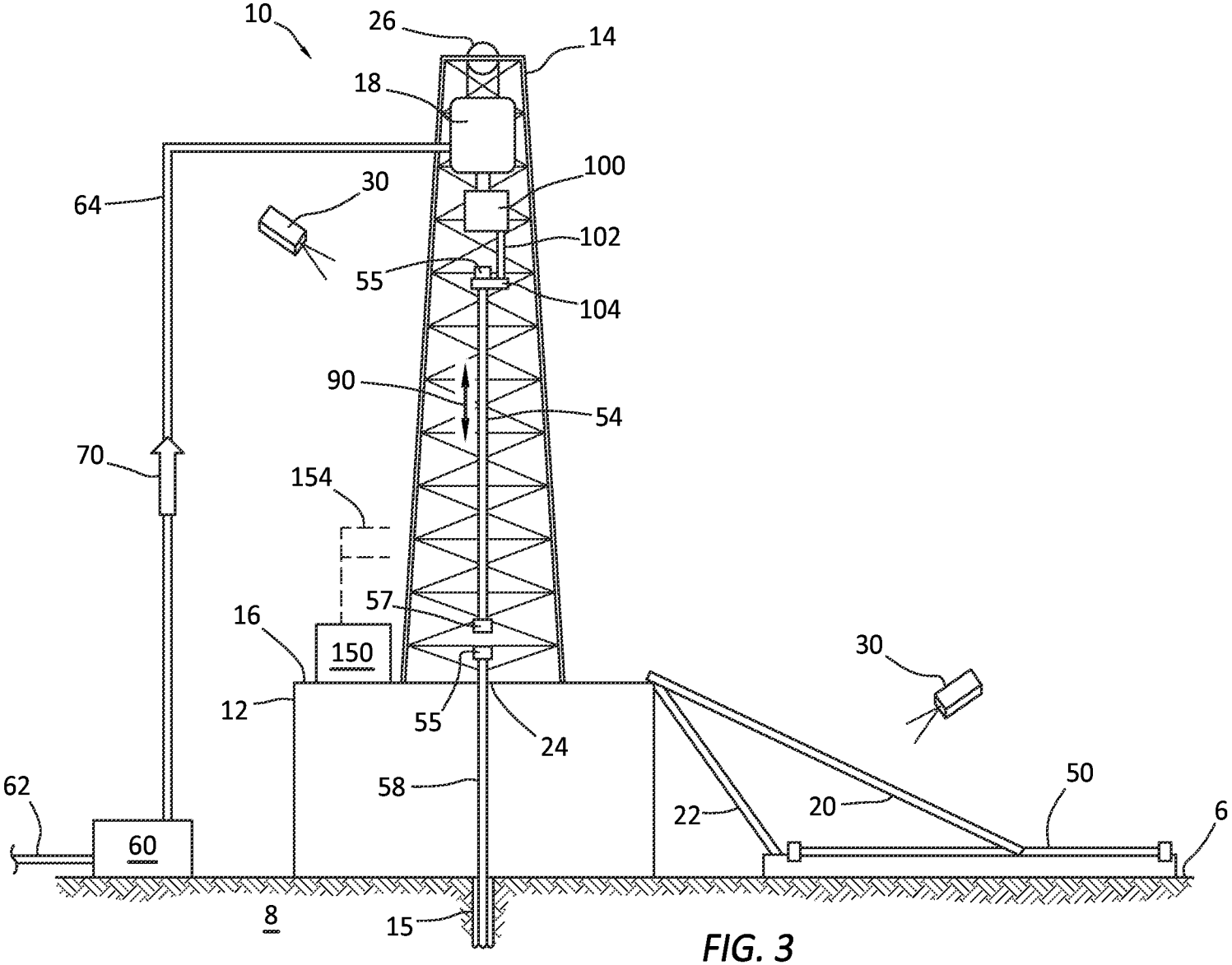

FIG. 3 shows the top drive 18 raised by the crown block 26 (arrows 90) and tubular running tool 100 supporting the tubular 54 before it is engaged with the tubular string 58. The elevator clamp 104 can engage the top end (e.g., box end 55) of the tubular 54 to suspend the tubular 54 from the tubular running tool 100.

Figure 4:
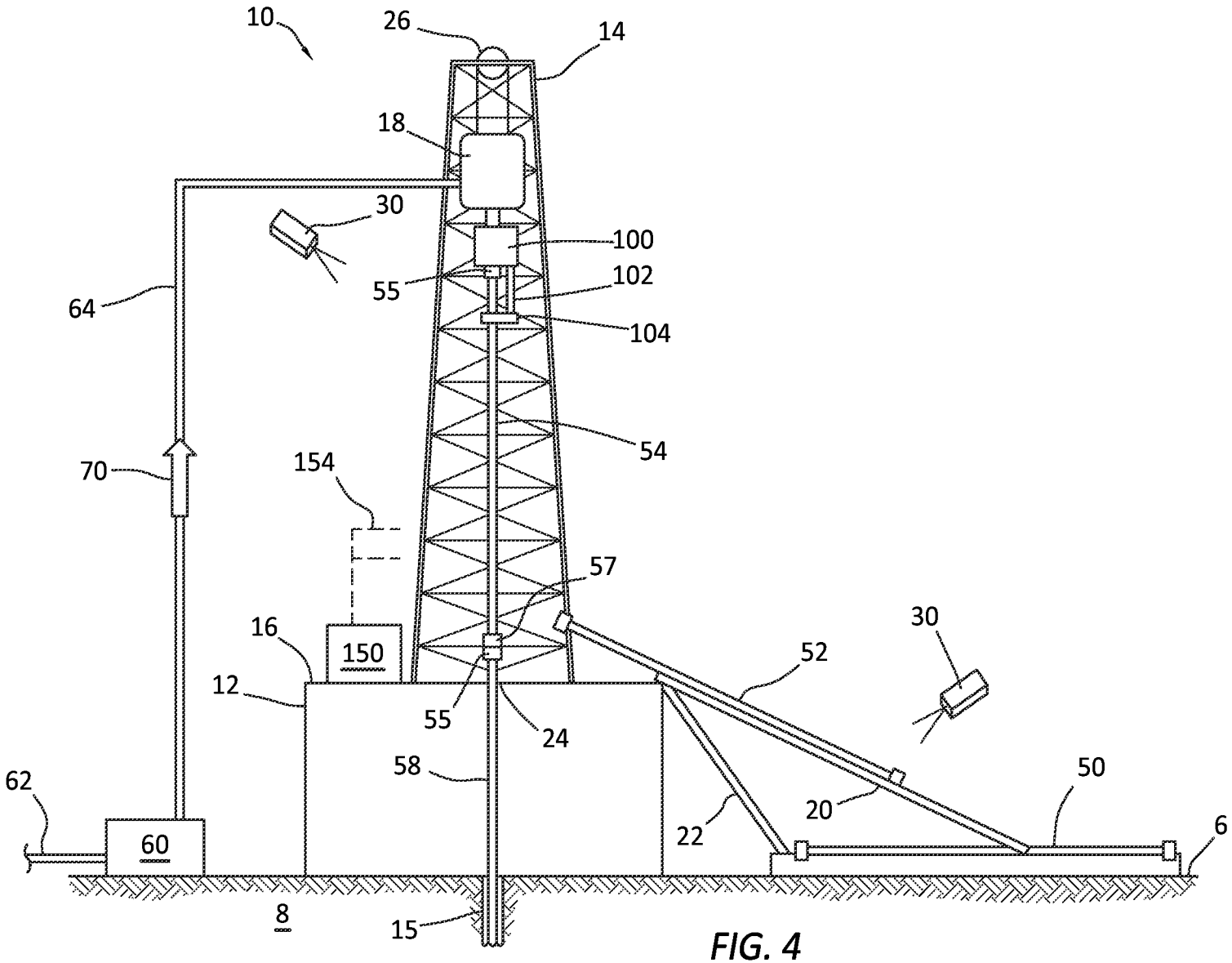

FIG. 4 shows the tubular running tool 100 lowered (arrows 90) to engage the lower end (e.g., pin end 57) of the tubular 54 with the top end (e.g., box end 55) and thread the two ends together to connect the tubular 54 to the tubular string 58. As the ends begin to be threaded together, the one or more pumps 60 can be run a predetermined number of strokes to fill the top of the tubular string 58 (now including the tubular 54) with a predetermined volume of fluid. This filling process can continue as the tubular string 58 (with the tubular 54) is lowered further into the wellbore 15. The filling process can end when the predetermined number of pump strokes is performed, and the predetermined volume of fluid is injected into the tubular string 58. It may be desirable to fill the tubular string 58 (after the tubular 54 has been connected to the top end of the tubular string 58) with fluid 70 such that at least 90%, or at least 89%, or at least 88%, or at least 87%, or at least 86%, or at least 85%, or at least 84%, or at least 83%, or at least 82%, or at least 81%, or at least 80%, or at least 75%, or at least 70%, or at least 65%, or at least 60%, or at least 55%, or at least 50%, or at least 25%, or at least 20%, or at least 15%, or at least 10%, or at least 5% of the volume of the tubular 54 is filled with the fluid 70.

The number of pump strokes necessary to fill the tubular 54 up to a desired percentage of the volume of the tubular 54 can be determined by calculating the total internal tubular volume TV54 of the tubular 54, determining the percentage of the TV54 to fill with the fluid, and then determining the number of pump strokes (PSn) needed to deliver the desired percentage of the tubular volume TV to the tubular string 58 after the tubular 54 has engaged the tubular string 58. Each pump stroke PSn (where "n" is a pump designation such as "1", "2", etc.) can deliver a specified quantity of the fluid 70 (i.e., fluid volume FVn, where "n" is a pump designation such as "1", "2", etc.) to the top drive 18 via the conduit 64. Multiple pumps 60 can be used with at least one of the pumps 60 having a different amount of fluid volume FV2 delivered per pump stroke PS2 compared to the fluid volume FV1 delivered per pump stroke PS1.

With multiple pumps, the fluid volume supplied by each pump per the individual pump stroke can be determined by manufacturer's data, experimentation, historical data, etc. Therefore, the fluid volume FVn to be delivered to the tubular string 58 via the top drive 18 can be calculated by determining the fluid volume FV1 supplied by a pump stroke PS1 of pump1 opf the pumps 60 and (if a second pump 60 is utilized) by determining the fluid volume FV2 supplied by a pump stroke PS2 of pump2 of the pumps 60. A third or more pumps 60 can be used with similar pump stroke/fluid volume designations to distinguish each one of the pumps 60. The total volume of fluid (FVtotal) supplied by the pumps 60 can be calculated by the equation:

$$FV_{total}=(N_1*FV_1)+(N_2*FV_2)+(\ldots)$$

Where FVtotal is the total fluid volume to be pumped into the tubular string 58, N1 is the number of pump strokes for pump1, FV1 is the fluid volume supplied by each pump1 stroke, N2 is the number of pump strokes for pump2, FV2 is the fluid volume supplied by each pump2 stroke, and (. . . ) represents additional pump strokes for different pumps than pump1 or pump2.

Therefore, in a simple example, if one pump 60 (e.g., pump1) is used to supply the fluid for the auto-filling process of the tubular string 58 when a new tubular segment 54 has been added, then FVtotal=N1*FV1. If the calculated number of strokes N1 is 10 and the fluid volume pumped per stroke is 3 liters, then FVtotal would be 30 liters pumped into the tubular string 58.

The total fluid volume (FVtotal) can be calculated such that pumping the fluid volume FVtotal into the tubular string 58, will fill the newly added tubular 54 (or tubular stand 54) up to at least 90%, or at least 89%, or at least 88%, or at least 87%, or at least 86%, or at least 85%, or at least 84%, or at least 83%, or at least 82%, or at least 81%, or at least 80%, or at least 75%, or at least 70%, or at least 65%, or at least 60%, or at least 55%, or at least 50%, or at least 25%, or at least 20%, or at least 15%, or at least 10%, or at least 5% of the internal volume of the tubular 54 (TV54) with the fluid 70.

Therefore, by calculating the internal volume of tubular 54 (TV54), the number of pump stokes Nn (where "n" is a pump designation such as "1", "2", etc.) for one or more pumps 60 that are needed to supply the total fluid volume FVtotal can be determined. As described above, the FVtotal can represent a volume of fluid needed to fill the newly connected tubular 54 to a desired percentage of the tubular volume (% TV). The FVtotal can also include an internal volume of the tubular string 58 (% TS) which is not yet filled with fluid 70.

For example, when the first tubular segment 54 of a tubular string 58 is introduced to the wellbore 15 at well center 24, the auto-fill process may calculate the total internal tubular 54 volume TV54 of the tubular string 58 (which consists of only one tubular segment 54), then the FVtotal needed to fill the tubular segment 54 to a desired percentage of the tubular volume % TV (e.g., 85% of TV54) with the fluid 70 can be determined. With FVtotal determined, the number of pump strokes Nn of the one or more pumps 60 can be calculated. Therefore, while the first tubular segment 54 is being positioned at well center 24 and lowered toward the wellbore 15, the auto-fill process, controlled via the rig controller 150, can run the one or more pumps 60 the determined number of pump strokes Nn to deliver the total volume of fluid 70 (FVtotal) to the tubular segment 54. In one example, where FVtotal fills the tubular segment 54 to 85% of the tubular 54 volume TV54 (85% TV), then the volume left unfilled in the tubular string 58 (TSV) could equal:

$$TSV=TV54-85\%\ TV$$

When the 2nd or subsequent tubular 54 is added to the tubular string 58, the total volume of fluid 70 (FVtotal) can be calculated to include the volume left unfilled in the tubular string 58 (TSV) by the previous auto-fill process, plus the volume fluid needed to fill a newly added tubular segment 54 to a desired percentage of the newly added tubular segment 54 (% TV). In some embodiments, such as % TV being equal to 85%, then the TSV could be 15% of the volume TV54 (15% TV) of the previously added tubular segment 54, which was not filled in the previous auto-fill process. Then the total fluid volume FVtotal to be added to the tubular string 58 can equal to 15% TV plus 85% TV, which should equal 100% of the volume of one tubular segment 54 TV54 (i.e., FVtotal=TV54) for subsequent tubulars 54 connected to the tubular string 58.

As way of another example, if % TV equaled 45%, then the TSV could be 55% of the volume TV54 (55% TV) of the previously added tubular segment 54, which was not filled in the previous auto-fill process. Then the total fluid volume FVtotal to be added to the tubular string 58 can be equal to 55% TV plus 45% TV, which can still equal 100% of the volume of one tubular segment 54 TV54 (i.e., FVtotal=TV54) for subsequent tubulars 54 connected to the tubular string 58. The process of determining the internal tubular volume TV54 is described in more detail below with regards to at least FIGS. 6 and 7.

It should be understood that the tubular 54 (or tubular segment 54) can include a tubular stand 54 with one or more tubular segments 54 already connected together before the tubular stand 54 is added to the tubular string 58.

In addition to calculating the number of pump stokes Nn needed to pump the desired volume to the tubular 54, the autofill process may also be configured to determine an optimum flow rate (i.e., strokes per minute SPM) at which to run the one or more pumps 60. The optimum flow rate SPM can be determined by dividing the total number of pump strokes Nn required to deliver the desired fluid volume to the tubular 54 by the total cycle time (Tcycle) from when a previous tubular connection was begun to when the running tool must disengage from the previous tubular to engage the next tubular 54. Therefore, the cycle time Tcycle is the time available to the tubular running tool 100 to inject the desired fluid volume into the tubular 54 before disengaging from the previous tubular 54 and proceed to engaging with the next tubular 54 to repeat the connection and autofill process.

By dividing the total pump strokes Nn by the cycle time Tcycle, the optimal flow rate SPM can be determined. It should be understood, that the cycle time Tcycle can also be selected by the rig controller 150 or an operator. The cycle time Tcycle is not required to be from when a previous tubular connection was begun to when the running tool must disengage from the previous tubular to engage the next tubular 54. For example, it may be desirable for the pumps to be run during a smaller time period than the time from when a previous tubular connection was begun to when the running tool must disengage from the previous tubular to engage the next tubular 54, such as reducing the cycle time Tcycle to allow enough time between when the pumps stop and when the running tool 100 disengages from the previous tubular 54 to prevent or at least minimize fluid spillage.

FIG. 5A illustrates an example tubular running tool 100 that can be used in the auto-fill processes of this disclosure. The tubular running tool 100 can interface to a top drive 18 via the coupling 106, which can receive fluid 70 from the top drive 18 and deliver the fluid 70 through the tubular running tool 100 to an internal volume of a tubular 54 TV54 via the coupling 108. In this example, the coupling 108 can engage an internal surface of the tubular 54 to secure the tubular 54 to the tubular running tool 100. The tubular running tool 100 can include a link pair 102 rotationally attached at one end to the tubular running tool 100 with the other end attached to an elevator clamp 104. As described above, the elevator clamp 104 can be actuated open or closed to selectively engage a top end (e.g., box end 55) of a tubular 52, 54 and lift it from the catwalk 20 and suspend the tubular 52, 54 until vertically positioned over the tubular string 58, engaged with the tubular string 58 at the bottom end of the tubular 54, and engaged with the tubular running tool 100 coupling 108 at the upper end of the tubular 54.

FIG. 5B illustrates another example tubular running tool 100 that can be used in the auto-fill processes of this disclosure. The tubular running tool 100 can interface to a top drive 18 via the coupling 106, which can receive fluid 70 from the top drive 18 and deliver the fluid 70 through the tubular running tool 100 to an internal volume of a tubular 54 TV54 via the coupling 108. In this example, the coupling 108 can engage an external surface of the tubular 54 to secure the tubular 54 to the tubular running tool 100. The tubular running tool 100 can include a link pair 102 rotationally attached at one end to the tubular running tool 100 with the other end attached to an elevator clamp 104. As described above, the elevator clamp 104 can be actuated open or closed to selectively engage a top end (e.g., box end 55) of a tubular 52, 54 and lift it from the catwalk 20 and suspend the tubular 52, 54 until vertically positioned over the tubular string 58, engaged with the tubular string 58 at the bottom end of the tubular 54, and engaged with the tubular running tool 100 coupling 108 at the upper end of the tubular 54.

As stated before, the auto-fill process for each newly added tubular 54 can begin with determining the total internal volume of the tubular 54 TV54 and then determining the % of the tubular volume TV54 (or % TV) that is desired to be filled with the fluid 70 as the top drive 18 and tubular running tool 100 connect the next tubular 54 to the tubular string and lower the newly added tubular 54 and tubular string 58 further into the wellbore 15. The tubular volume TV54 can be determined by knowing or determining an internal diameter of the tubular 54 and the length of the tubular 54. The internal volume can then be calculated by the formula TV54=π*((0.5*diameter)*2)*length. The calculation of the TV54 and the FVtotal is described in more detailed regarding FIGS. 6 and 7 below.

Figure 6:
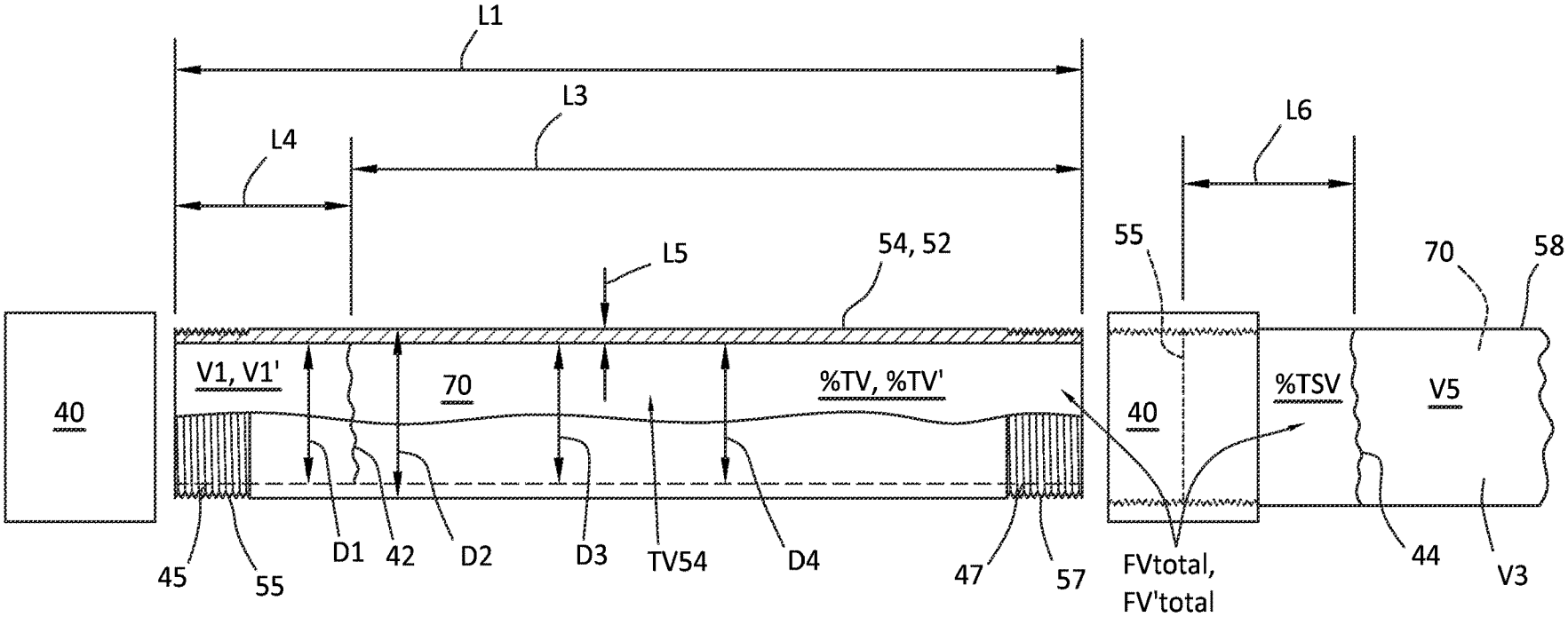
FIG. 6 is a representative partial cross-sectional view of a tubular segment and a tubular string stickup, in accordance with certain embodiments.

FIG. 6 is a partial cross-sectional view of a single segment tubular 54 in position to be connected to a top end (e.g., box end 55) of the tubular string 58. In this example, FIG. 6 illustrates a single segment casing segment as being the tubular 54 being added to a tubular string 58 (e.g., casing string). The tubular string 58 can have a coupling 40 attached to the upper end (i.e., threaded onto the upper end), wherein an elevator can engage the coupling 40 to carry the weight of the tubular string 58. Tubular segments 54 to be added can also have a coupling 40 added to an end opposite the end to be connected to the tubular string 58 via the coupling 40 on the top end of the tubular string 58. The coupling 40 is shown above the tubular 54 for clarity to show the full tubular 54 without the coupling connected. However, it should be understood that the coupling 40 should be connected to the tubular 54 before the tubular running tool 100 engages the tubular 54 on the catwalk 20 and manipulates the tubular 54 to well center 24.

To calculate the internal volume of the tubular 54 TV54, parameters of the tubular 54 can be determined from historical data, manufacturer's data, visual inspection, automated visual inspection (such as via imaging sensors 30), etc., where the parameters can include an overall length of the tubular segment 54 (L1), outer diameter(s) D2, inner diameter(s) D1, D3, D4, wall thickness L5. The historical data can include previously performed measurements, via manual or automated operations. The manufacturer's data can include parameters determined by the manufacturer (or representative) and delivered to the rig in association with the tubulars 54, 52. visual inspection can include manual visual inspection with operators making measurements of the tubulars 54, 52 directly, or automated visual inspection via imaging devices.

The automated visual inspection can determine the parameters of the tubulars 54, 52 by collecting imagery via an imaging sensor 30, analyzing the imagery via a rig controller 150, and calculating the parameters based on the imagery. An imaging sensor 30 can be a mobile or fixed camera, a handheld device (e.g., tablet, smartphone, video recorder, body cam, etc.), a camera mounted to a robot for automated manipulation of the camera, or combinations thereof. If an imaging sensor 30 captures imagery that includes the tubular 52, 54, depending on an orientation of the tubular 54, 52 relative to the imaging sensor 30. For example, a side view or an end view can be used to determine an outer diameter D2 of the tubular 52, 54. However, a side view may not allow measurements of the internal diameters D1, D3, D4. A perspective view can be used to determine the length of the tubular 52, 54, even with the coupling 40 installed, and a thickness of the tubular 52, 54.

Generally, such as with a casing string, the tubular 52, 54 may have a common inner diameter, where all inner diameters D1, D3, D4 are substantially equal to each other. However, the method of determining a volume of the tubular 52, 54 is still applicable even if it has multiple inner diameters where the inner diameters D1, D3, D4 (and possibly more) are different than one another. In the case of multiple inner diameters, the manufacturer's data can be used to determine the internal volume of the tubular 54 TV54 by adding up the individually calculated portions of the tubular volume TV54 which can be calculated by the diameter and length of each portion used to calculate the individual volume of the respective portion, such as π*((½*Dn)**2)*Ln (where "n" is a portion designation such as "1", "2", etc., Dn is the diameter of the portion, and Ln is the length of the portion), and adding the portions together to determine the tubular volume TV54. However, generally, the inner diameter D1 is substantially the same for the length L1 of the tubular 54, 52. Therefore, the internal volume of the tubular 54 TV54 can be calculated by the equation:

$$TV54 = \pi * \left(\frac{D_1}{2}\right)^2 * L_1$$

where:

TV54 is the internal volume of the tubular 54;

D1 is the inner diameter of the tubular 52, 54; and

L1 is the length of the tubular 54.

In FIG. 6, the tubular 54 includes a single tubular segment 54 (or tubular segment 52) which can be seen as a casing segment, but this auto-fill method is not limited to casing segments. This is merely one example of the tubular 54 that can benefit from the auto-fill process of this disclosure.

During the auto-fill process, it may be desirable to fill the tubular 52, 54 to a fill line 42 during the autofill process. The fill line 42 can represent a percentage of the TV54 (i.e., % TV) to be filled with the fluid 70 during the auto-fill process. The portion of TV54 (i.e. % TV) that is desired to be filled with fluid 70 as the tubular 54, 52 is being connected to the tubular string 58 and lowered into the wellbore 15, can be selected to be at least 90%, or at least 89%, or at least 88%, or at least 87%, or at least 86%, or at least 85%, or at least 84%, or at least 83%, or at least 82%, or at least 81%, or at least 80%, or at least 75%, or at least 70%, or at least 65%, or at least 60%, or at least 55%, or at least 50%, or at least 25%, or at least 20%, or at least 15%, or at least 10%, or at least 5% of the tubular volume 54 TV54.

The volume V1 above the fill line 42 can be calculated per equation below:

$$V1 = \pi * \left(\frac{D_1}{2}\right)^2 * L_4$$

The volume % TV below the fill line 42 can be calculated per equation below:

$$\%\ TV = \pi * \left(\frac{D_1}{2}\right)^2 * L_3$$

Therefore, TV54 equals V1+% TV (or V1'+% TV' defined below), where % TV is the internal volume of the tubular 54 that is to be filled by the fluid 70 during the auto-fill process for the tubular 54. When the tubular 54 is the first tubular added to the tubular string 58, then the total volume of fluid FVtotal can equal % TV. However, when the newly added tubular 54 is a 2nd or subsequent tubular added to the tubular string 58, then the total volume of fluid FVtotal can also include a portion of the tubular string 58 that was not filled in the previous auto-fill process for the previous tubular 54. As seen in FIG. 6, an internal volume V3 of the tubular string 58 can include the volume V5 that has been filled with the fluid 70 up to a fill line 44, which can be seen as the fill line 42 of the previously added tubular 54. Therefore, the unfilled volume V1 of the previous tubular 54 can be seen as the unfilled volume in the tubular string % TSV above the fill line 44. For the first tubular 54 of the tubular string, FVtotal can equal % TV, but for the subsequent tubulars 54, FVtotal can equal % TV+% TSV, where % TV is the volume of the newly added tubular 54 below the fill line 42 and % TSV is the previously unfilled portion of the tubular string 58 % TSV.

With FVtotal determined, the number of pump stokes PSn required for one or more pumps 60 to deliver the desired volume of fluid FVtotal to the tubular string 58 (when a new tubular 54 is added) can be determined by the equation:

$$PS_n = ROUND[FV_{total}/PV_n]$$

where:

PSn represents pump strokes for pump "n" with (FVtotal/PVn) rounded to nearest integer value;

FVtotal is the total volume of fluid needed to fill tubular 54 to the fill line 42; and PVn is the pump volume delivered for each pump stroke of pump "n". Due to a possible rounding error of the above equation for PSn, the FVtotal can be recalculated to determine FV'total by the equation:

$$FV'_{total} = PS_n * PV_n$$

This correction can be used to determine the expected volume of fluid 70 to be pumped by the pump "n" for the predetermined number of pump strokes PSn. The volume left unfilled in the tubular 54 above the fill line 42 after the auto-fill process can also be calculated by the equation:

$$V1' = TV54 - \%\ TV'$$

where % TV' can be calculated for the newly added tubular 54 by the equation:

$$\%\ TV' = FV_{total}' - \%\ TSV$$

If the newly added tubular 54 is the first in the tubular string 58, then % TSV could be zero "0" with % TV' being substantially equal to FV'total.

Therefore, when the single tubular segment 54 is added to the tubular string 58, the one or more pumps 60 can be run the desired number of pump strokes PSn to deliver the total volume of fluid 70 FV'total to the top drive 18 which in turn delivers the fluid 70 to the tubular 54 through the tubular running tool 100. Then, when connecting a subsequent tubular 54 to the tubular string 58, the volume V1' of the newly added tubular 54 becomes the % TSV of the tubular string 58.

Figure 7:
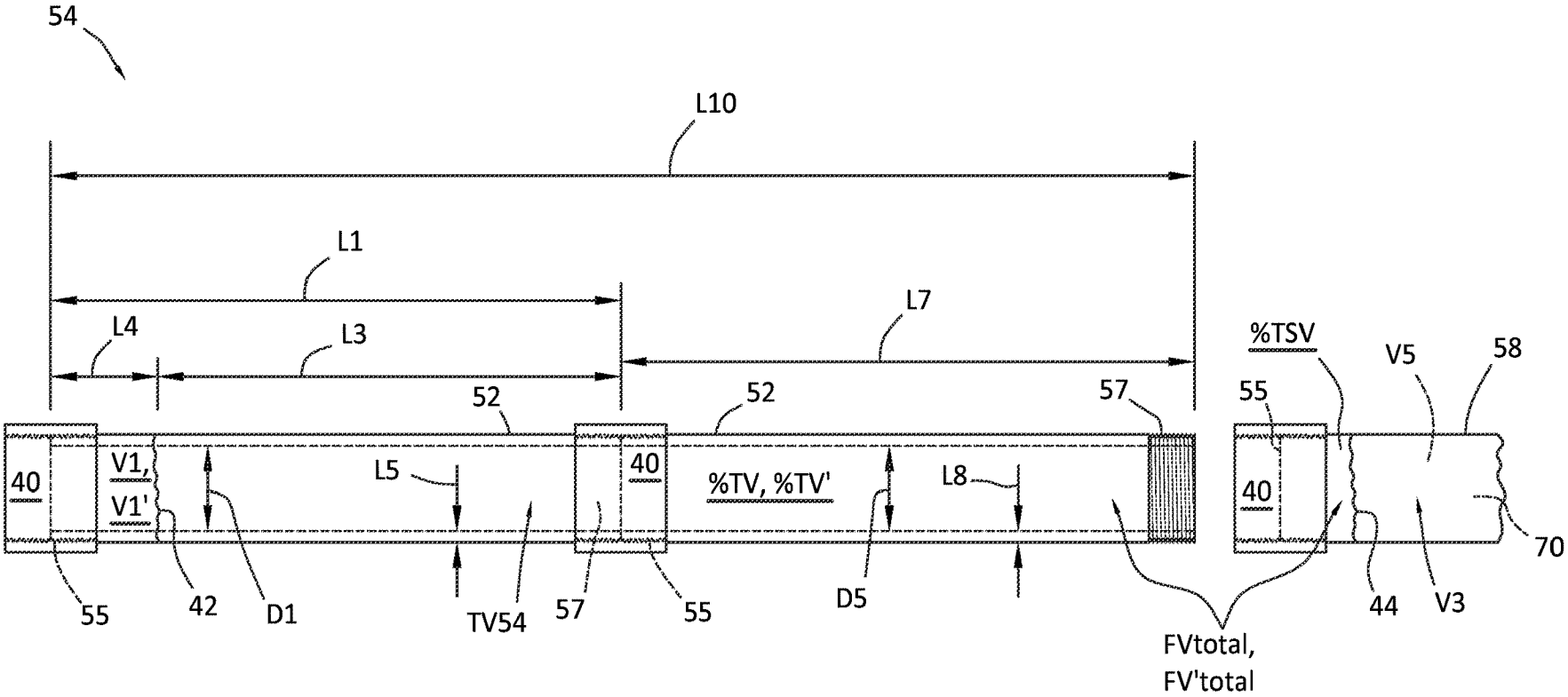
FIG. 7 is a representative partial cross-sectional view of a tubular stand and a tubular string stickup, in accordance with certain embodiments.

FIG. 7 shows a tubular stand 54 being added to a tubular string 58, with the tubular stand 54 including two tubular segments (referred to for clarity as tubulars 52 but can also be referred to as tubular segments 54). The process is very similar to the calculations performed regarding the configuration of FIG. 6, except the tubular volume TV54 includes the volume V10 of the first tubular 52 and the volume V11 of the second tubular 52.

In FIG. 7, the tubular 54 includes two tubular segments 52 which can be seen as a casing segment, but this auto-fill method is not limited to casing segments. The tubular segments 52 can be drill pipe segments with integral pin and box ends instead of couplings 40 at the box end 55, with the pin and box ends having a radially enlarged outer diameter portion proximate the respective end. These are merely other examples of the tubular 54 that can benefit from the auto-fill process of this disclosure.

During the auto-fill process, it may be desirable to fill the tubular 54 to a fill line 42 during the autofill process. The fill line 42 can represent a percentage of the TV54 (i.e., % TV) to be filled with the fluid 70 during the auto-fill process which can include volume V11 of the second tubular 52. The portion of TV54 (i.e. % TV) that is desired to be filled with fluid 70 as the tubular 54 (including multiple tubular segments 52) is being connected to the tubular string 58 and lowered into the wellbore 15, can be selected to be at least 90%, or at least 89%, or at least 88%, or at least 87%, or at least 86%, or at least 85%, or at least 84%, or at least 83%, or at least 82%, or at least 81%, or at least 80%, or at least 75%, or at least 70%, or at least 65%, or at least 60%, or at least 55%, or at least 50%, or at least 25%, or at least 20%, or at least 15%, or at least 10%, or at least 5% of the tubular volume 54 TV54.

The volume V1 above the fill line 42 can be calculated per the equation below:

$$V1 = \pi * \left(\frac{D_1}{2}\right)^2 * L_4$$

The volume % TV below the fill line 42 can be calculated per the equation below:

$$\%\ TV = \left(\pi * \left(\frac{D_1}{2}\right)^2 * L_3\right) + \left(\pi * \left(\frac{D_5}{2}\right)^2 * L_7\right)$$

where:

D1 is diameter of the first tubular segment 52;

L3 is the length of the first tubular segment 52;

D5 is diameter of the second tubular segment 52; and

L7 is the length of the second tubular segment 52.

It should be understood that more tubular segments 52 can be included in the tubular stand 54 and % TV can be calculated by adding the volume of the remaining tubular segments 52 similar to how the second tubular segment 52 was added above, compared to the equation for % TV for the single tubular segment 52 configuration of FIG. 6. Also, if any of the tubular segments 52 have varied inner diameters, then a volume for each portion of the tubular segment 52 with a different diameter can be calculated and added together to determine the overall internal volume for the tubular segment 52, which can then be combined with any additional tubular segments 52 in the tubular stand 54 to determine % TV of the tubular stand 54.

Volume of the tubular 54 (TV54) can equal V1+% TV (or V1'+% TV' defined below), where % TV is the internal volume of the tubular stand 54 that is to be filled by the fluid 70 during the auto-fill process for the tubular stand 54. When the tubular stand 54 is the first tubular added to the tubular string 58, then the total volume of fluid FVtotal can equal % TV. However, when the newly added tubular stand 54 is a 2nd or subsequent tubular stand 54 added to the tubular string 58, then the total volume of fluid FVtotal can also include a portion of the tubular string 58 that was not filled in the previous auto-fill process for the previous tubular stand 54. As seen in FIG. 7, an internal volume V3 of the tubular string 58 can include the volume V5 that has been filled with the fluid 70 up to a fill line 44, which can be seen as the fill line 42 of the previously added tubular stand 54. Therefore, the unfilled volume V1 of the previous tubular stand 54 can be seen as the unfilled volume in the tubular string % TSV above the fill line 44. For the first tubular 54 of the tubular string, FVtotal can equal % TV, but for the subsequent tubular stands 54, FVtotal can equal % TV+% TSV, where % TV is the volume of the newly added tubular stand 54 below the fill line 42 and % TSV is the previously unfilled portion of the tubular string 58 % TSV.

With FVtotal determined, the number of pump stokes PSn required for one or more pumps 60 to deliver the desired volume of fluid FVtotal to the tubular string 58 (when a new tubular stand 54 is added) can be determined by the equation:

$$PS_n = ROUND[FV_{total}/PV_n]$$

where:

PSn represents pump strokes for pump "n" with (FVtotal/PVn) rounded to nearest integer value;

FVtotal is the total volume of fluid needed to fill tubular 54 to the fill line 42; and PVn is the pump volume delivered for each pump stroke of pump "n". Due to a possible rounding error of the above equation for PSn, the FVtotal can be recalculated to determine FV'total, where:

$$FV'_{total} = PS_n * PV_n$$

This correction can be used to determine the expected volume of fluid 70 to be pumped by the pump "n" for the predetermined number of pump strokes PSn. The volume left unfilled in the tubular stand 54 above the fill line 42 after the auto-fill process can also be recalculated by the equation:

$$V1' = TV54 - \%\ TV'$$

where % TV' can be calculated for the newly added tubular stand 54 by the equation:

$$\%\ TV' = FV_{total}' - \%\ TSV$$

If the newly added tubular stand 54 is the first in the tubular string 58, then % TSV could be zero "0" with % TV' being substantially equal to FV'total.

Therefore, when the single tubular stand 54 is added to the tubular string 58, the one or more pumps 60 can be run the desired number of pump strokes PSn to deliver the total volume of fluid 70 FV'total to the top drive 18 which in turn delivers the fluid 70 to the tubular 54 through the tubular running tool 100. Then, when connecting a subsequent tubular stand 54 to the tubular string 58, the volume V1' of the newly added tubular 54 becomes the % TSV of the tubular string 58.

Some processes can fill the tubular string to a level detected by a sensor, which can be used to turn the one or more pumps off. When the sensor detects the fluid has filled the tubular string to the desired level, the sensor may indicate to a controller that the fluid has reached the desired level in the tubular string and turn the pumps off is response to the sensor detection. However, this operation more often than not can result in the pumps being shut-off during a pump stroke. Abruptly stopping a pump in mid-stroke can cause a pressure spike on the inlet lines or output lines of the pumps. This can be called "dead heading" the pumps, which can cause undue wear and fatigue on the pumps and supporting equipment. Also, with the pumps pumping fluid through the top drive to the tubular string, abruptly stopping fluid flow when the sensor detects fluid at a desired level proximate the top end of the tubular string can also cause spillage of the fluid out of the top end of the tubular string. Therefore, the current method that calculates the number of pump strokes for the pump's "n" PSn and then runs the pumps 60 for the predetermined number of pump strokes PSn to fill the tubular string 58 to a desired level can allow the pumps to complete each pump stoke and prevent dead heading caused by abrupt stopping of the pumps or abrupt closing a valve on the output of the pumps to stop fluid flow.

Figure 8:
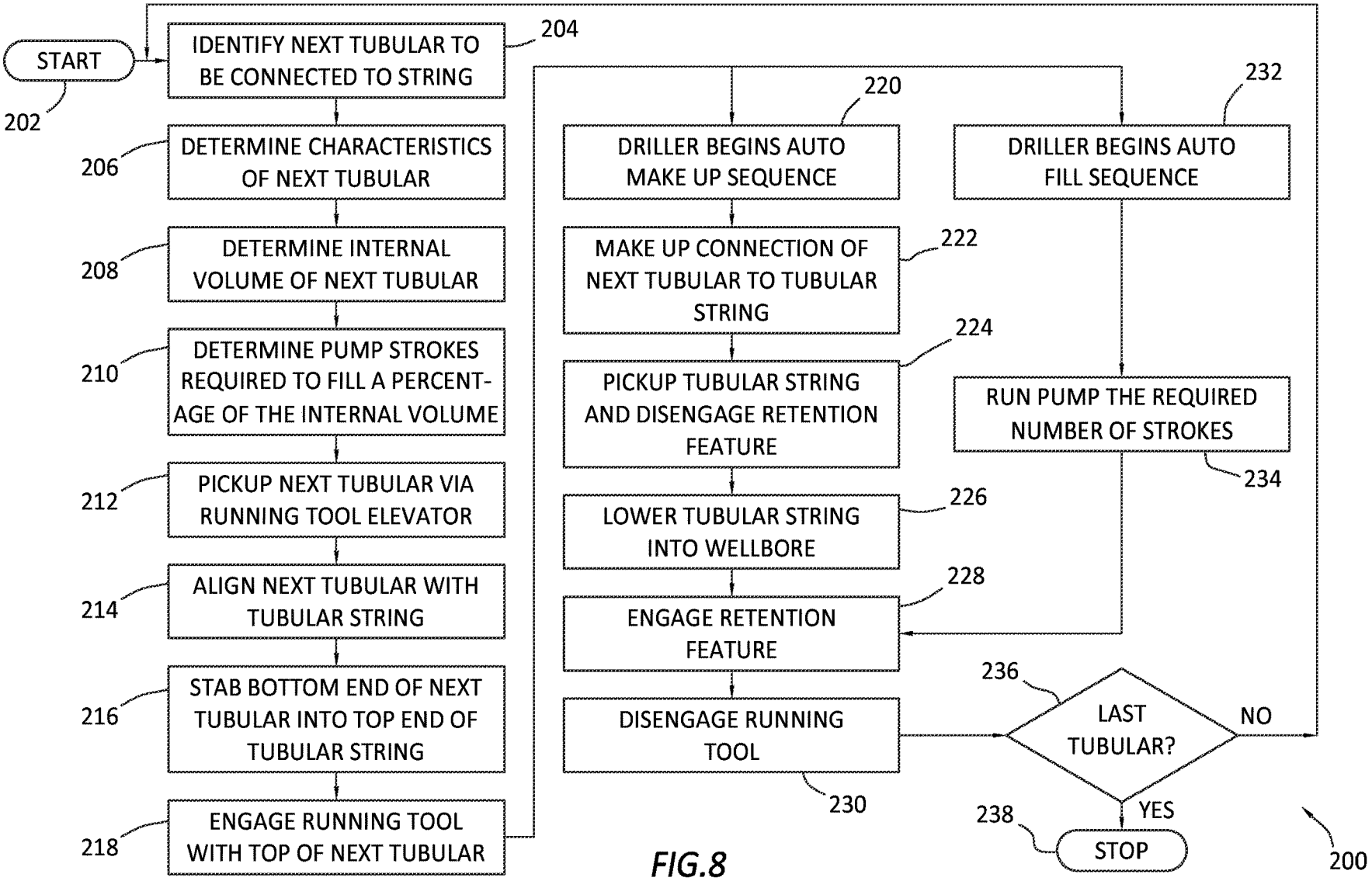
FIG. 8 is a representative flow diagram for auto filling a tubular, in accordance with certain embodiments.

FIG. 8 is a representative flow diagram of a method 200 for auto filling a tubular string 58 as new tubulars 54 are added to the tubular string 58 during a process for running the tubular string 58 into the wellbore 15. The method 200 can begin at operation 202 when a rig is beginning to assemble a tubular string 58 at a well center 24 in a rig floor 16. Operation 204 is used to identify the next tubular 54 that is to be connected to the tubular string 58 at the well center 24. If the next tubular 54 is the first tubular of the tubular string 58, then the auto-till process will fill a portion (% TV) of the internal volume of the tubular 54 TV54 without also filling a remaining portion in the upper end of the tubular string 58, since this next tubular 54 is actually the first tubular 54 of the tubular string 58. Second and subsequent tubulars 54 can require filling not only the percentage of the tubular volume % TV of the next tubular 54, but also the remaining portion % TSV in the upper end of the tubular string 58.

Operation 206 can determine the necessary parameters of the next tubular 54 to support the following volume calculations. The parameters can include the diameter of each portion of the tubular 54 that may have different diameters and also the lengths of each portion with different diameters. Referring to FIG. 6, the diameters can be the inner and outer diameters (D1-D4) of the tubular 54 as well as the lengths of each portion with a different diameter. In the case of FIG. 6, the diameters D1, D3, D4 are indicated as being equal, therefore, L1 can represent the length of the portion with diameter D1. The diameter D1 can be directly measured via rig personnel or imaging sensors, can be determined from manufacturer's data or other historical data, and can be derived by measuring or otherwise knowing the outer diameter D2 and a wall thickness L5 of the tubular 54.

Referring to FIG. 7, L1 can represent the length of the portion with diameter D1, and L7 can represent the length of the portion with diameter D5. The diameters D1, D5 can be directly measured via rig personnel or imaging sensors, can be determined from manufacturer's data or other historical data, and can be derived by measuring or otherwise knowing the outer diameter (e.g., D2) and a wall thickness L5, L8 of the tubulars 52 that make up the tubular stand 54. When parameters of drill pipe type tubulars, then the length L1 or L7 can be defined as the distance from the inner shoulder of the box end 55 threads 45 to the end shoulder of the pin end 57 threads 47. If there are different diameters between these shoulders, then the lengths L1 and L7 can be divided into the lengths of each portion with a varied inner diameter.

Operation 208 can, based on the parameters determined in operation 206, determine the total internal volume TV54 of the tubular 54. TV54 can be calculated based on the previously described methods and equations.

Operation 210 can determine the number of pump strokes PSn to drive the one or more pumps 60 to fill the tubular 54 to a desired percentage of the total internal volume TV54 of the tubular 54. This operation can be adjusted as desired by the rig operators or rig controller 150 to facilitate auto-filling of the tubular 54 as it is connected to the tubular string 58. To calculate the pump strokes PSn, the percentage of the total internal volume TV54 of the tubular can be selected (such as at least 90%, or at least 89%, or at least 88%, or at least 87%, or at least 86%, or at least 85%, or at least 84%, or at least 83%, or at least 82%, or at least 81%, or at least 80%, or at least 75%, or at least 70%, or at least 65%, or at least 60%, or at least 55%, or at least 50%, or at least 25%, or at least 20%, or at least 15%, or at least 10%, or at least 5%, etc.).

With a percentage chosen, then the pump strokes PSn can be determined with the volume of fluid pumped for each stroke PVn being known for each pump 60. The percentage of the tubular volume TV54 (% TV) can be determined by % TV=(X %*TV54), where X % represents the selected percentage and % TV is the volume of the tubular 54 to be filled with the fluid 70. If this is the first tubular 54, then % TV is the total fluid volume FVtotal to be filled by the fluid 70 in the tubular string 58. However, if the tubular 54 is the second or subsequent tubular 54, then FVtotal will include % TV plus the amount previously unfilled in the tubular string 58 (i.e., % TSV). With FVtotal determined, then the number of pump strokes PSn can be determined by dividing the FVtotal by the volume per pump stroke PVn.

Operation 212 can pick up the next tubular 54 with the elevator clamp 104 of the tubular running tool 100, with operation 214 vertically aligning the next tubular 54 with the tubular string 58 at well center 24. Operation 216 can lower the tubular running tool 100 and allow the bottom end (e.g., pin end 57) of the next tubular 54 to be stabbed into the upper end (e.g., box end) of the tubular string 58. In operation 218, with the ends stabbed together, the tubular running tool 100 can be further lowered to engage the top end (e.g., box end 55) of the tubular 54.

It should be understood that the operations 204-210 can be run at least partially in parallel (or simultaneously) with operations 212-218.

The operations 220-228 can be run in parallel with operations 232, 234. In operations 220, 222, a driller can begin an auto-make up sequence for threading and torquing the ends together to make a connection of the next tubular 54 to the tubular string 58 and lower the tubular string 58 a desired distance into the wellbore 15 such that a next tubular 54 can be added to the tubular string 58. In operation 224, the top drive 18 and tubular running tool 100 combination can lift the tubular string 58 with the newly added tubular 54 and allow a retention feature at well center 24 (e.g., slips) to be disengaged from the tubular string 58, thereby allowing the top drive 18 and tubular running tool 100 combination to lower the tubular string 58 into the wellbore 15 in operation 226.

In operation 228, when the tubular string 58 has been lowered to the desired height above the rig floor 16, the retention feature (e.g., slips) at the well center 24 can be reengaged with the tubular string 58 to suspend the tubular string 58 from the rig floor 16 and, in operation 230, allow the running tool to be disengaged from the upper end (e.g., box end 55) of the tubular string 58 so the process of adding another tubular 54 to the tubular string 58 can continue. In operation 236, the driller can determine if that was the last tubular 54 to be added to the tubular string 58. If it was the last tubular 54, then the tripping in of the tubular string 58 can end (operation 238). If it was not the last tubular 54 to be added to the tubular string 58, then the process can begin again at operation 204.

In operations 232, 234, the driller can begin an auto-fill sequence for filling the next tubular 54 to a fill line 42 which can represent the percentage of tubular volume % TV (or % TV') of the next tubular 54 to be filled with the fluid 70. The auto-fill process can then run the one or more pumps 60 the predetermined number of pump strokes PSn to deliver the total volume of fluid FVtotal (or FV'total) to the tubular string 58 which is calculated to fill the next tubular 54 to (or at least proximate to) the predetermined fill line 42 (i.e., fill % TV or % TV' of the next tubular 54 with fluid 70). The calculation of the number of pump strokes PSn is described in detail above, as well as other calculated parameters (e.g., % TV, % TV', FVtotal, FV'total, etc.).

The auto-fill process can (and is preferrable to be) run in parallel (or simultaneously) to the auto-make up process and tubular string 58 lowering process to minimize rig time for running in a tubular string 58 into the wellbore 15. This novel approach to at least partially filling new tubulars 54 as they are being added to a tubular string 58 by running one or more pumps a predetermined number of pump strokes PSn reduces run time for the running in process and minimizes wear and fatigue on pumps and support equipment by not causing "dead heading" of the pumps during the process.

VARIOUS EMBODIMENTS

Embodiment 1. A method for performing a subterranean operation, the method comprising:

engaging a tubular with a pipe handler;

calculating, via a processor, an internal volume of the tubular;

based on the internal volume, determining, via the processor, a number of pump strokes required to fill at least a percentage of the internal volume with fluid;

pumping the fluid to the tubular by running a pump the number of pump strokes; and filling the internal volume of the tubular to at least the percentage of the internal volume with the fluid.

Embodiment 2. The method of embodiment 1, further comprising: engaging the tubular, via the pipe handler, with a tubular string and extending the tubular string along with the tubular further into a wellbore while pumping the fluid to the tubular.

Embodiment 3. The method of embodiment 1, wherein calculating the internal volume of the tubular further comprises determining at least one characteristic of the tubular and calculating, via the processor, the internal volume of the tubular based on the at least one characteristic.

Embodiment 4. The method of embodiment 3, further comprising:

capturing imagery of the tubular via an imaging sensor; and determining, via the processor, the at least one characteristic based on the captured imagery.

Embodiment 5. The method of embodiment 4, wherein the at least one characteristic comprises one of an inner diameter of the tubular, a length of the tubular, an outer diameter of the tubular, a thickness of a wall of the tubular, or combinations thereof.

Embodiment 6. The method of embodiment 1, wherein determining, via the processor, a number of pump strokes required to fill at least 90%, or at least 89%, or at least 88%, or at least 87%, or at least 86%, or at least 85%, or at least 84%, or at least 83%, or at least 82%, or at least 81%, or at least 80%, or at least 75%, or at least 70%, or at least 65%, or at least 60%, or at least 55%, or at least 50%, or at least 25%, or at least 20%, or at least 15%, or at least 10%, or at least 5% of the internal volume with fluid.

Embodiment 7. The method of embodiment 1, wherein determining, via a processor, a number of pump strokes required to fill at least 85% of the internal volume with fluid.

Embodiment 8. The method of embodiment 1, wherein the pump comprises a first pump and a second pump, the method further comprising:

determining, via the processor, a first number of pump strokes of the first pump and a second number of pump strokes of the second pump required to fill at least the percentage of the internal volume with fluid.

Embodiment 9. The method of embodiment 8, wherein pumping the fluid to the tubular further comprises:

running the first pump the first number of pump strokes;

running the second pump the second number of pump strokes; and filling the internal volume of the tubular to at least the percentage of the internal volume with the fluid.

Embodiment 10. The method of embodiment 9, wherein a fluid volume for each pump stroke of the first pump is a different fluid volume for each pump stroke of the second pump.

Embodiment 11. The method of embodiment 9, wherein a fluid volume for each pump stroke of the first pump is substantially the same fluid volume for each pump stroke of the second pump.

Embodiment 12. The method of embodiment 8, wherein determining, via the processor, the first number of pump strokes of the first pump and the second number of pump strokes of the second pump required to fill at least 85% of the internal volume of the tubular with fluid.

Embodiment 13. The method of embodiment 12, wherein pumping the fluid to the tubular further comprises:

running the first pump the first number of pump strokes;

running the second pump the second number of pump strokes; and filling the internal volume of the tubular to at least 85% with the fluid.

Embodiment 14. The method of embodiment 1, wherein engaging the tubular comprises engaging a running tool to an end of the tubular, with the running tool coupled to a top drive, wherein the pump comprises one or more pumps, and wherein the pumping the fluid comprises pumping, via one or more pumps, fluid to the top drive, through the running tool, and into the tubular when another end of the tubular is engaged with a tubular string.

Embodiment 15. The method of embodiment 13, wherein pumping the fluid further comprises running the one or more pumps a predetermined number of pump strokes needed to fill the internal volume of the tubular to a predetermined percentage of the internal volume with the fluid.

Embodiment 16. A method for performing a subterranean operation, the method comprising:

engaging a tubular with a pipe handler;

initiating, via a processor, an automated connection process which automatically connects the tubular to a tubular string at a well center; and initiating, via the processor, an automated fluid fill process which automatically fills the tubular with a fluid to a predetermined percentage of an internal volume of the tubular, while automatically connecting the tubular to the tubular string, wherein the automated fluid fill process comprises running one or more pumps a predetermined number of pump strokes.

Embodiment 17. The method of embodiment 16, wherein engaging the tubular comprises:

engaging a running tool to an end of the tubular, with the running tool coupled to a top drive; and pumping, via the one or more pumps, fluid to the top drive, through the running tool, and into the tubular when another end of the tubular is engaged with the tubular string.

Embodiment 18. The method of embodiment 16, further comprising: prior to initiating the automated fluid fill process, determining at least one characteristic of the tubular; and determining an internal volume of the tubular based on the at least one characteristic.

Embodiment 19. The method of embodiment 18, further comprising determining the at least one characteristic based on one of historical data, manufacturer's data, visual inspection, automated visual inspection, or combinations thereof.

Embodiment 20. The method of embodiment 19, wherein the historical data comprises previously performed measurements, via manual or automated operations.

Embodiment 21. The method of embodiment 19, wherein the manufacturer's data comprises parameters determined by a manufacturer of the tubular and delivered to a rig in association with the tubular.

Embodiment 22. The method of embodiment 19, wherein the visual inspection comprises manual visual inspection with an operator directly taking measurements of the tubular or automated visual inspection via an imaging sensor.

Embodiment 23. The method of embodiment 22, wherein the imaging sensor comprises a mobile or fixed camera on a rig, a handheld device carried by an operator, (such as a tablet, a smartphone, a video recorder, a body camera, or combinations thereof), a camera mounted to a robot for automated manipulation of the camera on the rig, or combinations thereof.

Embodiment 24. The method of embodiment 18, wherein the at least one characteristic comprises one of an inner diameter of the tubular, a length of the tubular, an outer diameter of the tubular, a thickness of a wall of the tubular, or combinations thereof.

Embodiment 25. The method of embodiment 16, further comprising prior to initiating the automated fluid fill process, determining a total volume of fluid required to fill the tubular to at least the predetermined percentage of the internal volume of the tubular.

Embodiment 26. The method of embodiment 25, wherein determining the total volume of fluid comprises:

determining the internal volume of the tubular;

determining the predetermined percentage of the internal volume of the tubular to be filled with the fluid;

determining a portion of an internal volume of the tubular string to be filled with the fluid; and determining the predetermined number of pump strokes required to fill the internal volume of the tubular to at least the predetermined percentage of the internal volume of the tubular and to fill the portion of an internal volume of the tubular string with the fluid.

Embodiment 27. The method of embodiment 26, further comprising:

running the one or more pumps the predetermined number of pump strokes and filling the portion of the internal volume of the tubular string with fluid and filling the internal volume of the tubular to at least the predetermined percentage of the internal volume of the tubular.

Embodiment 28. The method of embodiment 27, further comprising:

simultaneously running the one or more pumps the predetermined number of pump strokes, while running the tubular string, along with the tubular, into a wellbore; and after running the one or more pumps the predetermined number of pump strokes, disengaging the pipe handler from the tubular.

Embodiment 29. The method of embodiment 28, further comprising, for each new tubular added to the tubular string, repeating the operations of:

determining the total volume of fluid required to fill the tubular to at least the predetermined percentage of the internal volume of the tubular;

engaging the tubular with the pipe handler;

connecting the tubular to the tubular string;

simultaneously running the one or more pumps the predetermined number of pump strokes while running the tubular string along with the tubular into the wellbore; and disengaging the pipe handler from the tubular.

Embodiment 30. The method of embodiment 16, further comprising:

determining a cycle time which is defined by the time from when the pipe handler engages the tubular with the tubular string to when the pipe handler disengages from the tubular after the tubular is filled with a fluid to a predetermined percentage of an internal volume of the tubular; and determining an optimal flow rate for the one or more pumps by distributing the predetermined number of pump strokes along the cycle time.

Embodiment 31. A method according to any automated fluid filling process described in this disclosure.

While the present disclosure may be susceptible to various modifications and alternative forms, specific embodiments have been shown by way of example in the drawings and tables and have been described in detail herein. However, it should be understood that the embodiments are not intended to be limited to the particular forms disclosed. Rather, the disclosure is to cover all modifications, equivalents, and alternatives falling within the spirit and scope of the disclosure as defined by the following appended claims. Further, although individual embodiments are discussed herein, the disclosure is intended to cover all combinations of these embodiments.

The invention claimed is:

1. A method for performing a subterranean operation, the method comprising:

engaging a tubular with a pipe handler;

calculating, via a processor, an internal volume of the tubular;

based on the internal volume, determining, via the processor, a number of pump strokes required to fill at least a percentage of the internal volume with fluid;

pumping the fluid to the tubular by running a pump the number of pump strokes;

engaging the tubular, via the pipe handler, with a tubular string and lowering the tubular string along with the tubular while pumping the fluid into the tubular; and filling the internal volume of the tubular to at least the percentage of the internal volume with the fluid.

2. The method of claim 1, further comprising:

pumping the fluid to the tubular while slips are disengaged from the tubular string.

3. The method of claim 1, wherein calculating the internal volume of the tubular further comprises determining at least one characteristic of the tubular and calculating, via the processor, the internal volume of the tubular based at least on the at least one characteristic.

4. The method of claim 3, further comprising:

capturing imagery of the tubular via an imaging sensor; and determining, via the processor, the at least one characteristic based on the captured imagery.

5. The method of claim 4, wherein the at least one characteristic comprises one of an inner diameter of the tubular, a length of the tubular, an outer diameter of the tubular, a thickness of a wall of the tubular, or combinations thereof.

6. The method of claim 1, wherein determining, via the processor, a number of pump strokes required to fill at least 5% of the internal volume with fluid.

7. The method of claim 1, wherein the pump comprises a first pump and a second pump, the method further comprising:

determining, via the processor, a first number of pump strokes of the first pump and a second number of pump strokes of the second pump required to fill at least the percentage of the internal volume with fluid.

8. A method for performing a subterranean operation, the method comprising:

engaging a tubular with a pipe handler;

calculating, via a processor, an internal volume of the tubular;

based on the internal volume, determining, via the processor, a number of pump strokes required to fill at least a percentage of the internal volume with fluid;

pumping the fluid to the tubular by running a pump the number of pump strokes;

filling the internal volume of the tubular to at least the percentage of the internal volume with the fluid, wherein the pump comprises a first pump and a second pump, the method further comprising:

determining, via the processor, a first number of pump strokes of the first pump and a second number of pump strokes of the second pump required to fill at least the percentage of the internal volume with fluid;

running the first pump the first number of pump strokes;

running the second pump the second number of pump strokes; and filling the internal volume of the tubular to at least the percentage of the internal volume with the fluid.

9. The method of claim 7, wherein determining, via the processor, the first number of pump strokes of the first pump and the second number of pump strokes of the second pump required to fill at least 85% of the internal volume of the tubular with fluid.

10. The method of claim 1, wherein engaging the tubular comprises engaging a running tool to an end of the tubular, with the running tool coupled to a top drive, wherein the pump comprises one or more pumps, and wherein the pumping the fluid comprises pumping, via the one or more pumps, fluid to the top drive, through the running tool, and into the tubular when another end of the tubular is engaged with a tubular string.

11. A method for performing a subterranean operation, the method comprising:

engaging a tubular with a pipe handler;

initiating, via a processor, an automated connection process which automatically connects the tubular to a tubular string at a well center; and initiating, via the processor, an automated fluid fill process which automatically fills the tubular with a fluid to a predetermined percentage of an internal volume of the tubular, while automatically connecting the tubular to the tubular string, wherein the automated fluid fill process comprises running one or more pumps a predetermined number of pump strokes.

12. The method of claim 11, wherein engaging the tubular comprises:

engaging a running tool to an end of the tubular, with the running tool coupled to a top drive; and pumping, via the one or more pumps, fluid to the top drive, through the running tool, and into the tubular when another end of the tubular is engaged with the tubular string.

13. The method of claim 11, further comprising:

prior to initiating the automated fluid fill process, determining at least one characteristic of the tubular; and determining an internal volume of the tubular based on the at least one characteristic.

14. The method of claim 13, further comprising determining the at least one characteristic based on one of historical data, manufacturer's data, visual inspection, automated visual inspection, or combinations thereof.

15. The method of claim 14, wherein the historical data comprises previously performed measurements, via manual or automated operations, wherein the manufacturer's data comprises parameters determined by a manufacturer of the tubular and delivered to a rig in association with the tubular, and wherein the visual inspection comprises manual visual inspection with an operator directly taking measurements of the tubular or automated visual inspection via an imaging sensor.

16. The method of claim 13, wherein the at least one characteristic comprises one of an inner diameter of the tubular, a length of the tubular, an outer diameter of the tubular, a thickness of a wall of the tubular, or combinations thereof.

17. The method of claim 11, further comprising:

prior to initiating the automated fluid fill process, determining a total volume of fluid required to fill the tubular to at least the predetermined percentage of the internal volume of the tubular.

18. The method of claim 17, wherein determining the total volume of fluid comprises:

determining the internal volume of the tubular;

determining the predetermined percentage of the internal volume of the tubular to be filled with the fluid;

determining a portion of an internal volume of the tubular string to be filled with the fluid; and determining the predetermined number of pump strokes required to fill the internal volume of the tubular to at least the predetermined percentage of the internal volume of the tubular and to fill the portion of an internal volume of the tubular string with the fluid.

19. The method of claim 18, further comprising:

running the one or more pumps the predetermined number of pump strokes and filling the portion of the internal volume of the tubular string with fluid and filling the internal volume of the tubular to at least the predetermined percentage of the internal volume of the tubular;

simultaneously running the one or more pumps the predetermined number of pump strokes, while running the tubular string, along with the tubular, into a wellbore; and after running the one or more pumps the predetermined number of pump strokes, disengaging the pipe handler from the tubular.

20. The method of claim 11, further comprising:

determining a cycle time which is defined by a time from when the pipe handler engages the tubular with the tubular string to when the pipe handler disengages from the tubular after the tubular is filled with a fluid to a predetermined percentage of an internal volume of the tubular; and determining an optimal flow rate for the one or more pumps by distributing the predetermined number of pump strokes along the cycle time.

* * * * *